US006092264A

United States Patent [19]

Banks

[11] Patent Number: 6,092,264

[45] Date of Patent: Jul. 25, 2000

[54] SINGLE AXIS FOLD ACTUATOR AND LOCK FOR MEMBER

[75] Inventor: Johnny E. Banks, Arlington, Tex.

[73] Assignee: Lockheed Martin Corporation, Bethesda, Md.

[21] Appl. No.: 09/191,492

[22] Filed: Nov. 13, 1998

[51] Int. Cl.[7] ..... E05D 11/10

[52] U.S. Cl. ..... 16/321; 16/289; 16/306; 244/3.27

[58] Field of Search ..... 16/321, 331, 332, 16/282, 283, 289, 290, 294, 295, 299, 300, 305, 306, 307, 374, 375; 244/3.27, 3.29, 49

[56] References Cited

U.S. PATENT DOCUMENTS

| | | | |
|---|---|---|---|
| 267,447 | 11/1882 | Muller et al. | 16/321 |
| 2,591,476 | 4/1952 | Swanson | 16/307 |
| 2,858,765 | 11/1958 | Startzell | 244/3.29 |
| 2,924,175 | 2/1960 | Jasse | 244/3.29 |
| 2,935,761 | 5/1960 | Frohlich | 16/283 |
| 3,029,043 | 4/1962 | Churchill | 244/7 |
| 3,058,422 | 10/1962 | Olsson | 102/50 |
| 3,273,500 | 9/1966 | Kongelbeck | 244/3.29 |
| 3,711,040 | 1/1973 | Carver | 244/3.21 |
| 3,999,246 | 12/1976 | Suska | 16/136 |
| 4,296,895 | 10/1981 | Pazmany | 244/3.29 |
| 4,323,208 | 4/1982 | Ball | 244/3.28 |
| 4,419,788 | 12/1983 | Prout | 16/300 |
| 4,453,728 | 6/1984 | Verge | 16/305 |
| 4,501,045 | 2/1985 | Boyer | 15/331 |
| 4,588,146 | 5/1986 | Schaeffel et al. | 244/3.27 |
| 4,778,127 | 10/1988 | Duchesneau | 244/3.27 |
| 4,884,766 | 12/1989 | Steinmetz et al. | 244/3.27 |
| 4,984,967 | 1/1991 | Cruzen | 416/140 |
| 5,192,037 | 3/1993 | Moorefield | 244/46 |
| 5,326,049 | 7/1994 | Rom et al. | 244/3.28 |
| 5,383,253 | 1/1995 | Lin | 16/54 |
| 5,820,072 | 10/1998 | Na et al. | 244/3.27 |
| 5,829,715 | 11/1998 | Banks | 244/49 |
| 5,894,633 | 4/1999 | Kaneko | 16/306 |

FOREIGN PATENT DOCUMENTS

| | | |
|---|---|---|
| 0013096 | 7/1980 | European Pat. Off. . |
| 3405974 | 4/1985 | Germany . |
| 2041502 | 9/1980 | United Kingdom . |
| 1597098 | 9/1981 | United Kingdom . |
| 2140136 | 11/1984 | United Kingdom . |
| 2154715 | 9/1985 | United Kingdom . |
| 9531689 | 11/1995 | WIPO . |
| 8805898 | 8/1998 | WIPO . |

*Primary Examiner*—Chuck Y. Mah
*Attorney, Agent, or Firm*—Sidley & Austin; Stephen S. Sadacca

[57] ABSTRACT

A mechanism (10, 100) is disclosed for deploying a mechanism, such as an air foil or antenna (14, 102, 104) which utilizes a pivot axle (16) and a torsion spring (18) to pivot the erectable surface to the erected position. A locking pin 22 can be provided to lock the erectable surface (14) in the erected position. In one embodiment, a wing (102) and a control fin (104) can be deployed about a single axis.

18 Claims, 5 Drawing Sheets

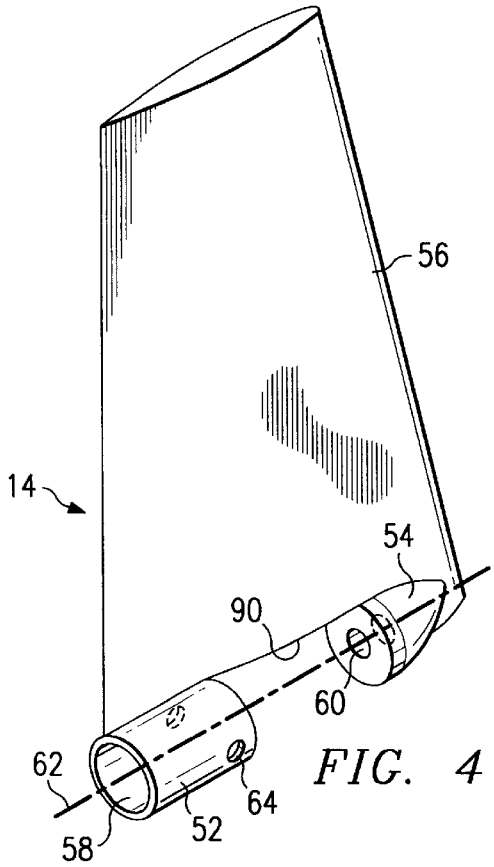
FIG. 4
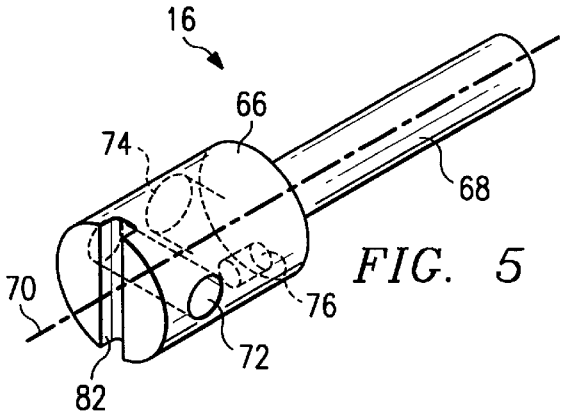
FIG. 5
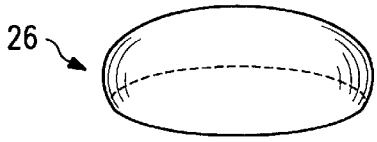
FIG. 6
FIG. 7
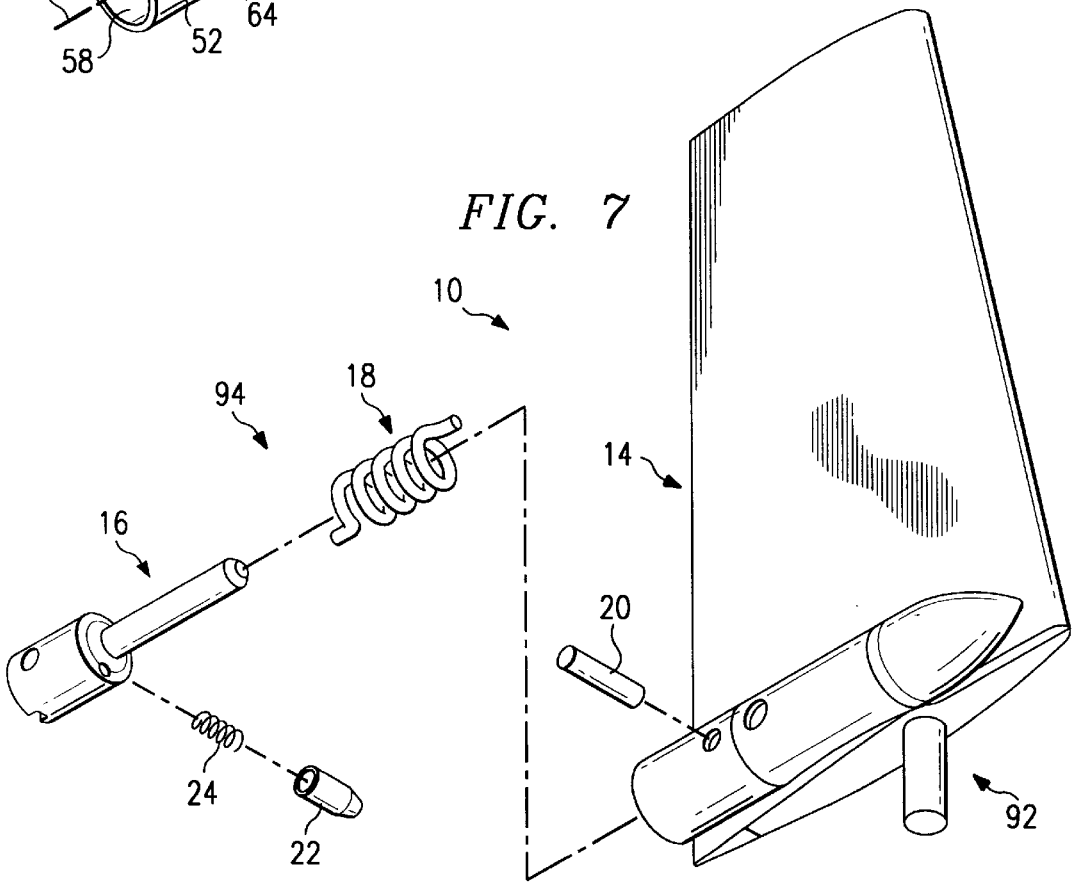

SINGLE AXIS FOLD ACTUATOR AND LOCK FOR MEMBER

TECHNICAL FIELD

This invention relates to deployment of a member from a folded position to an erect position, particularly for use on a missile, rocket or the like.

BACKGROUND OF THE INVENTION

It is often desirable to be able to move a member, such as an aerodynamic surface, or antenna, from a storage position to an erected position. In particular, to facilitate maximum load out of submunitions in delivery vehicles such as TACMs or MLRS, folding aerodynamic surfaces on the submunition are often required. Such a construction preferably has a minimum intrusive volume, a minimum of complexity and high reliability. A need exists for an effective design for the deployment of aerodynamic surfaces, antennas and other members in such an environment.

SUMMARY OF THE INVENTION

In accordance with one aspect of the present invention, a hinge and locking mechanism is provided to deploy a member from a storage position to an erected position. The mechanism includes a support base and an erectable member. A pivot axle is secured to one of the support base and the erectable member and pivotally engaged with the other for rotation about a first axis. A spring element urges the erectable member to rotate in a first direction about the first axis to the erected position.

In accordance with another aspect of the present invention, a locking pin is provided which is movable between an unlocked position and a locked position. The locking pin locks the erectable member in the erected position. In accordance with another aspect of the present invention, a locking pin spring can be provided to urge the locking pin into the locked position. A deformable bump stop can be provided to cushion movement of the erectable member into the erected position. The spring element can be a helical spring.

BRIEF DESCRIPTION OF THE DRAWINGS

For a more complete understanding of the present invention and for further advantages thereof, reference is now made to the following description of the preferred embodiment taken in conjunction with the accompanying drawings in which:

FIG. 4 is a perspective view of the aerodynamic surface of the mechanism;

FIG. 5 is a perspective view of the pivot axle of the mechanism;

FIG. 6 is a perspective view of the deformable bump stop of the mechanism;

FIG. 7 is an exploded perspective view of the mechanism;

DETAILED DESCRIPTION

Figure 1:
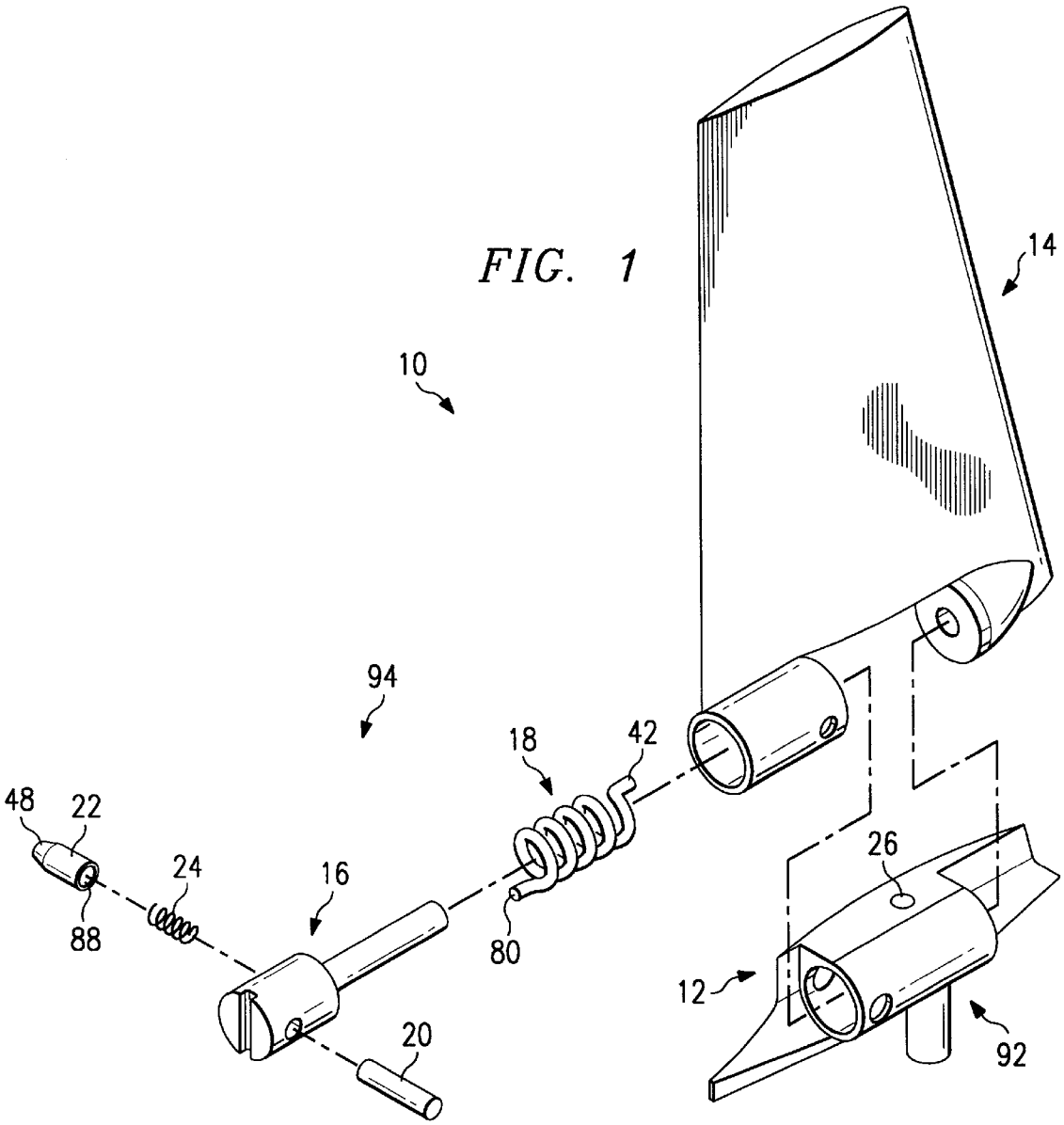
FIG. 1 is a perspective view of a mechanism forming a first embodiment of the present invention.

With reference now to the figures, and in particular to FIGS. 1–10, a single axis folding and locking mechanism 10 will be described. The mechanism, with reference to FIG. 1, consists of a number of parts which include a support base 12, an erectable surface 14, a pivot axle 16, a torsion spring 18, a pivot axle securing pin 20, a locking pin 22, a locking pin actuation spring 24 and a deformable bump stop 26.

Figure 2:
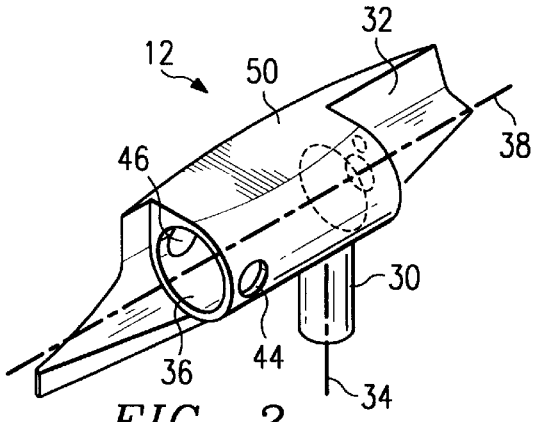
FIG. 2 is a perspective view of a first version of the support base of the mechanism.
Figure 3:
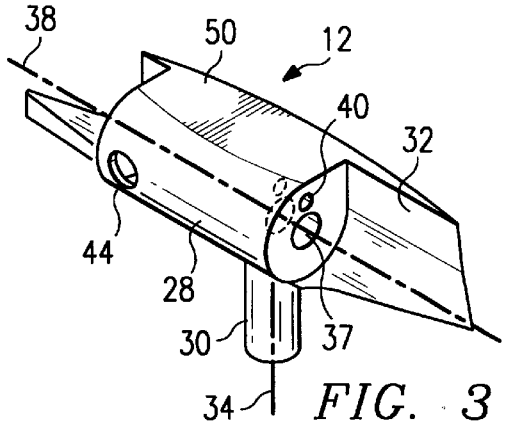
FIG. 3 is a perspective view of an alternative version of the support base.
Figure 9:
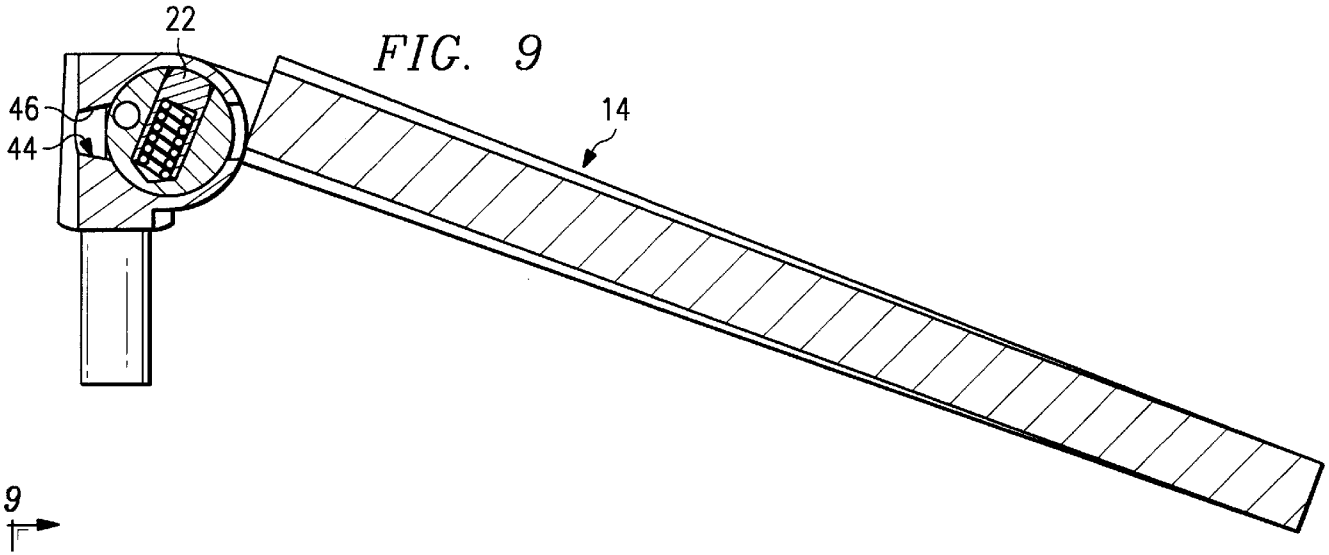
FIG. 9 is a cross section of FIG. 8 taken along line 9—9.
Figure 10:
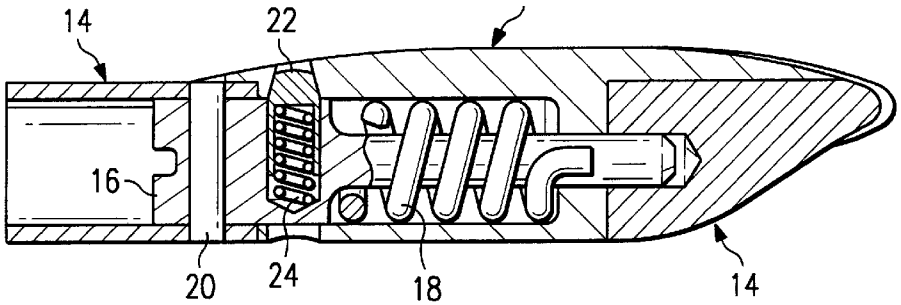
FIG. 10 is a cross section of FIG. 8 taken along line 10—10.
Figure 8:
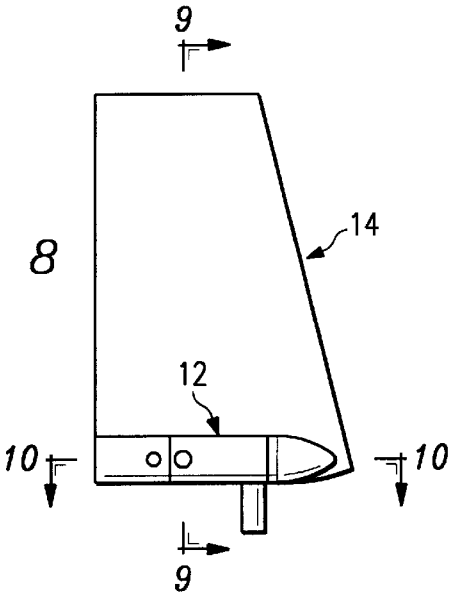
FIG. 8 is a side view of the mechanism.

With reference to FIGS. 2 and 3, the support base 12 is a single piece consisting of a main axle barrel 28 aligned in a generally cordwise direction with the desired aerodynamic surface 14, a base to main body attachment provision 30 and fairing material 32 to maintain the desired aerodynamic shape around the moving portions of the erectable surface 14. The support base 12 can either be rigidly attached to a main body with multiple attachment provisions 30, or, as illustrated in FIGS. 2 and 3, can be attached along axis 34 to an actuation device such as would be necessary for an all moving control fin application. FIGS. 2 and 3 illustrate a slight variation of the location of the attachment provision 30 which can be designed for the particular configuration most desirable.

A stepped aperture 36 is drilled through the main axle barrel 28 in a generally cordwise direction, defining a larger portion 35 and a smaller portion 37. The axis 38 of aperture 36 becomes the axis around which folding of the erectable surface 14 occurs. Axis 38 and axis 34 can be displaced from each other so as not to intersect. Such displacement may facilitate clearance of other objects or portions of the main body while in the folded condition.

At the end of the main axle barrel 28 which has the smaller portion 37 of stepped aperture 36, a second aperture 40, axially displaced from stepped aperture 36, is drilled through the main axle barrel 28. This aperture 40 receives and locks in place one end 42 of the torsion spring 18. The placement of aperture 40 around axis 38 will be driven by the desired amount of torsion spring preload when the assembled mechanism is in the erected position.

An aperture 44 is drilled through both sides of the main axle barrel 28 perpendicular to and passing through axis 38 near the end of the main axle barrel 28 which contains the larger portion of the stepped aperture 36. Surface 46 of aperture 44 is tapered slightly to interface with the tapered surface 48 of locking pin 22. Drilling through the main axle barrel 28 in this manner allows a single process to be used to produce the tapered portion of the aperture 44.

Surface 50 of the main axle barrel 28 can either support the deformable bump stop 26 or be the impacting surface for a deformable bump stop which is mounted on or in the erectable surface 14.

With reference to FIG. 4, the erectable surface 14 can be seen to be a single piece consisting of a pivot axle barrel 52, a pivot axle barrel fairing 54 and the main aerodynamic surface 56. An aperture 58, equivalent in diameter to the larger portion 35 of the stepped aperture 36 in the main axle barrel 28 of the support base 12, is drilled through the pivot axis barrel 52. A second aperture 60, axially aligned with the aperture 58 and equivalent in diameter to the smaller portion 37 of the stepped aperture 36 in the main axle barrel 28 of the support base 12 is drilled into a portion of the pivot axle barrel fairing 54. The axis 62, created by apertures 58 and 60, becomes the folding axis for the erectable surface 14. An aperture 64 is drilled through the pivot axle barrel 52 perpendicular to and intersecting the axis 62 and also perpendicular to the aerodynamic cord line of the aerodynamic surface 56 to accept the pivot axle securing pin 20 which locks the pivot axle 16 to the erectable surface 14.

As seen in FIG. 5, the pivot axle 16 is a stepped cylindrical pin with a larger diameter surface 66 and a smaller diameter surface 68, both aligned with an axis 70. At assembly, the larger surface 66 is inserted into both aperture 58 of the erectable surface 14 and the larger portion 35 of the stepped aperture 36 in the support base 12. The smaller surface 68 passes through the smaller portion 37 of the stepped aperture 36 of the support base 12 and into aperture 60 of the erectable surface 14. As such, proper mechanical clearances should be allowed between these mating parts. An aperture 72 is drilled through the larger surface 66 of pivot axle 16, perpendicular to and intersecting the axis 70 and near the end of the pivot axle 16. Aperture 72 accepts the pivot axis securing pin 20 which locks the pivot axle 16 to the erectable surface 14. A second aperture 74 is drilled into, but does not fully pierce, the pivot axle 16 through the larger surface 66 of the pivot axle 16, perpendicular to and intersecting the axis 70 and parallel to aperture 72 near the smaller surface 68. Aperture 74 accepts the locking pin 22 and the locking pin spring 24. A third aperture 76 is drilled into the surface 78 of the pivot axle 16 forming the transition between surfaces 66 and 68 parallel to but offset from axis 70. Aperture 76 accepts the other end 80 of the torsion spring 18 and ties the motion of the pivot axle 16 to the support base 12 through twisting of the torsion spring 18. A slot 82 is cut into the larger end of the pivot axle 16 to facilitate alignment of the subassembly including pivot axle 16, torsion spring 18, locking pin 22 and locking pin spring 24, when this subassembly is inserted into the support base 12 and erectable surface 14.

The torsion spring 18 is a helically wound spring with wire ends 42 and 80 that are parallel to the axis of the helix. The end 42 of the spring is inserted into aperture 40 of the support base 12 while the other wire end 80 is inserted into the aperture 76 of the pivot axle 16. The outer diameter, inner diameter, number of turns, wire diameter and final length of torsion spring 18 are dependent upon the application forces desired. As such, the spring forces required may drive the diameters and lengths of the pivot axle 16, main axle barrel 28, pivot axle barrel 52 and pivot axle barrel fairing 54.

The pivot axle securing pin 20 can be either a spring roll pin or a solid cylindrical pin of appropriate diameter having a press fit within the aperture 72 of the pivot axle 16 and the aperture 64 of pivot axle barrel 52. Its length should be the same as the outer diameter of the pivot axle barrel 52 of the erectable surface 14. The pivot axle securing pin 20 ties the motion of the pivot axle 16 and the erectable surface 14 together.

The locking pin 22 has a short tapered surface 48 which interfaces with the tapered surface 46 of aperture 44 in the support base 12 when the assembly is in the erected position. A bore 88 in the opposite end of the locking pin 22 accepts the locking pin spring 24. This subassembly, in turn, is installed in aperture 74 of the pivot axle 16 with the tapered surface 48 to the outside. The length of the locking pin 22 is such that, when installed in aperture 74 of the pivot axle 16, it can be compressed against the locking pin spring 24 until the tip of the locking pin 22 is at least flush with the maximum outer diameter of the pivot axle 16. Proper mechanical clearances will be allowed between these mating parts.

The locking pin spring 24 is a simple helical wound spring with flat ends, and of sufficient strength to hold the tapered surface 48 of the locking pin 22 in constant engagement with the tapered surface 46 of the aperture 44 in support base 12 under all loading conditions for the erectable surface 14 when erected.

With reference to FIGS. 1 and 6, the deformable bump stop 26 is employed as an energy absorption device to decelerate the erection rate of the erectable surface 14 and reduce the shock loads on the total assembly at the end of the erection phase. Either elastic or plastic deformation of the deformable bump stop 26 can be employed. However, elastic deformation is more desirable if the assembly is to be cycled multiple times. The deformable bump stop 26 could be something as simple as a small piece of silicon glue applied upon surface 50 of the support base 12 of sufficient height and mass to be compressed between surface 50 of the support base 12 and surface 90 of the erectable surface 14 as the erectable surface 14 approaches the fully erected position. Alternatively, some type of plunger, spring, damper or deformable material, or combination thereof, could be mounted in a cavity bored into the surface 90, similar to the application of the locking pin 22 and locking pin spring 24 to the pivot axle 16. The applied deformable bump stop method chosen would be governed by the loads and deceleration rates desired, as well as cost and physical space limitations.

A subassembly 92 is formed by mating the support base 12 and erectable surface 14 as shown in FIGS. 1 and 7. In the subassembly 92, the axes 38 of the support base 12 and axis 62 of the erectable surface 14 are aligned. A second subassembly 94 is formed by initially inserting the locking pin spring 24 into bore 88 of the locking pin 22. Subsequently, these parts are then inserted into the aperture 74 of the pivot axle 16 with the tapered surface 48 of the locking pin 22 to the outside. While holding the locking pin 22 in place, surface 68 of the pivot axle 16 is inserted through the center of the torsion spring 18 and the wire end 80 of the torsion spring 18 is inserted into aperture 76 of the pivot axle 16.

The subassembly 94 is inserted into the aperture 58 of the erectable surface 14 with the subassembly 94 rotated to align the wire end 42 of the torsion spring 18 with aperture 40 in the support base 12. The locking pin 22 must be depressed sufficiently for the subassembly 94 to be fully inserted into the subassembly 92.

Using a blade screwdriver or similar device inserted into the slot 82 of the pivot axle 16, the pivot axle 16 can be rotated, counterclockwise in the figures shown, until the locking pin 22 snaps into the tapered surface 46 of aperture 44 in the support base 12. The subassembly 94 is then locked into the erected position.

The erectable surface 14 can be rotated into the erected position and the pivot axle securing pin 20 can be inserted or pressed through the aperture 64 of the erectable surface and aperture 72 of the pivot axle 16 until the ends are flush with the surface of the pivot axle barrel 52 of the erectable surface 14.

To unlock and fold the erectable surface 14 for the installation of the deformable bump stop 26, the exposed end of the locking pin 22 can be pressed, as visible through the tapered side of the aperture 44 in the support base 12, until the locking pin 22 is depressed sufficiently to allow rotation of the erectable surface 14. If a deformable bump stop 26 is desired, the erectable surface 14 is preferably secured in the folded position until installation of the deformable bump stop 26 can be completed.

As will be apparent, the erectable surface 14 can be maintained in the folded position by any suitable mechanism, including a pin or locking element received in the attachment provision 30, which prevents rotation of the pivot axle 16 until it is desired for the erectable surface 14 to move to the erected position. When erection is to occur, the locking element can be withdrawn from engagement with the pivot axle 16, permitting the force of the torsion spring 18 to rotate the erectable surface 14 to the erected position, where it is then held in that position by the locking pin 22 and locking pin actuation spring 24.

Figure 11:
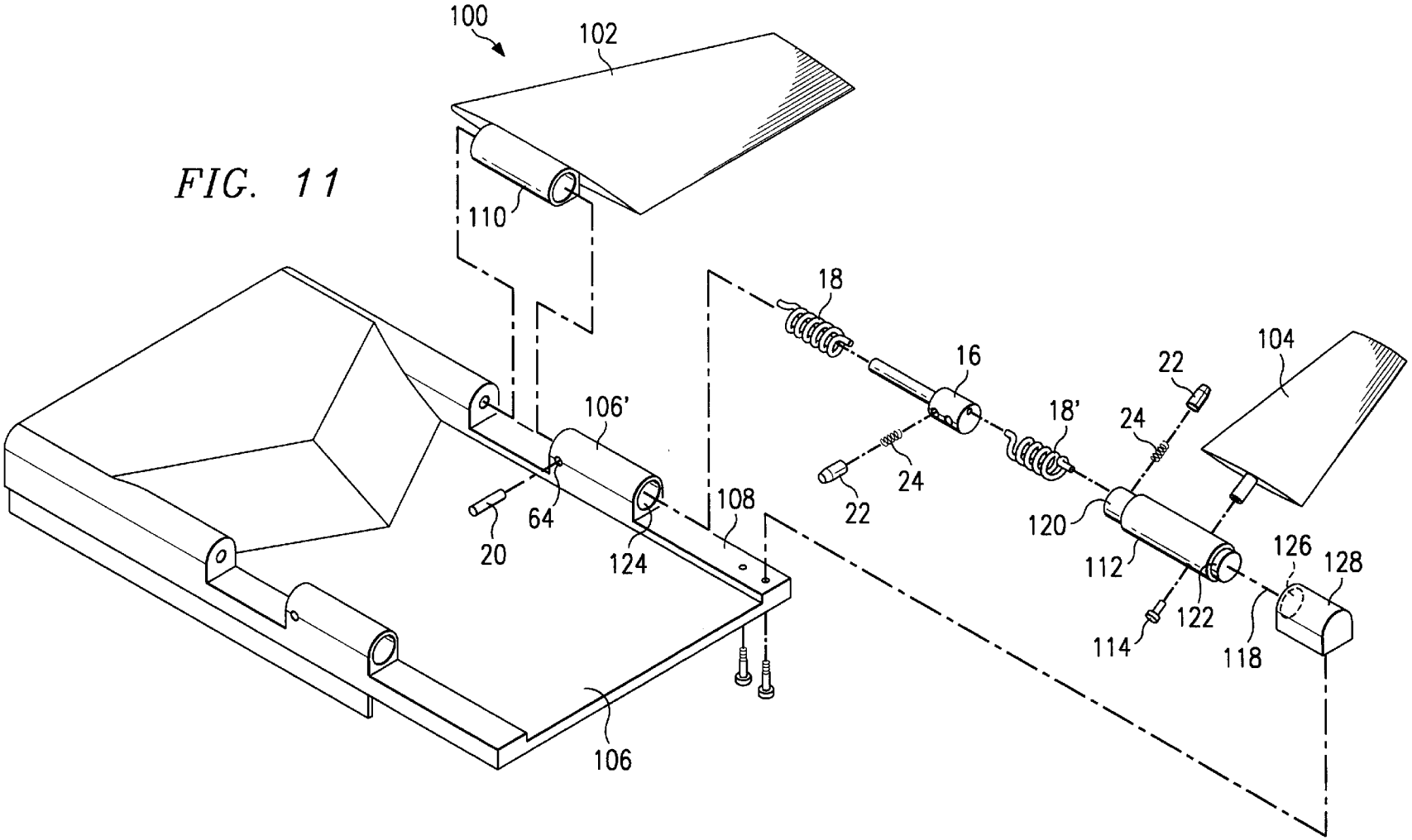
FIG. 11 is an exploded perspective view of a mechanism forming a second embodiment of the present invention.
Figure 12:
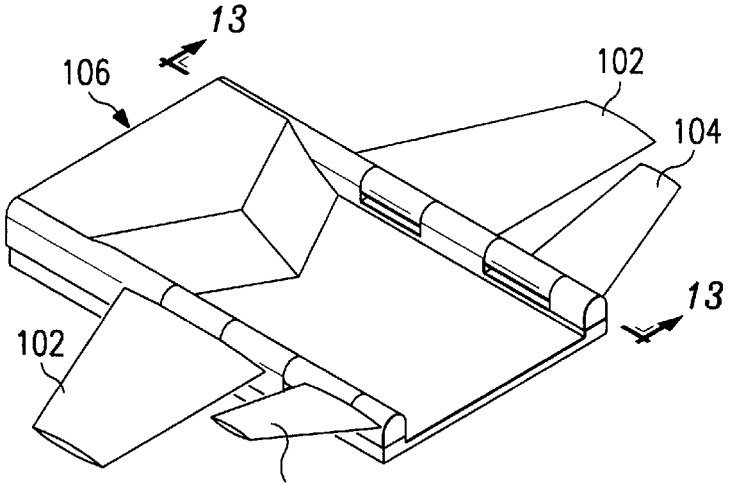
FIG. 12 is a perspective view of the mechanism of FIG. 11.
Figure 13:
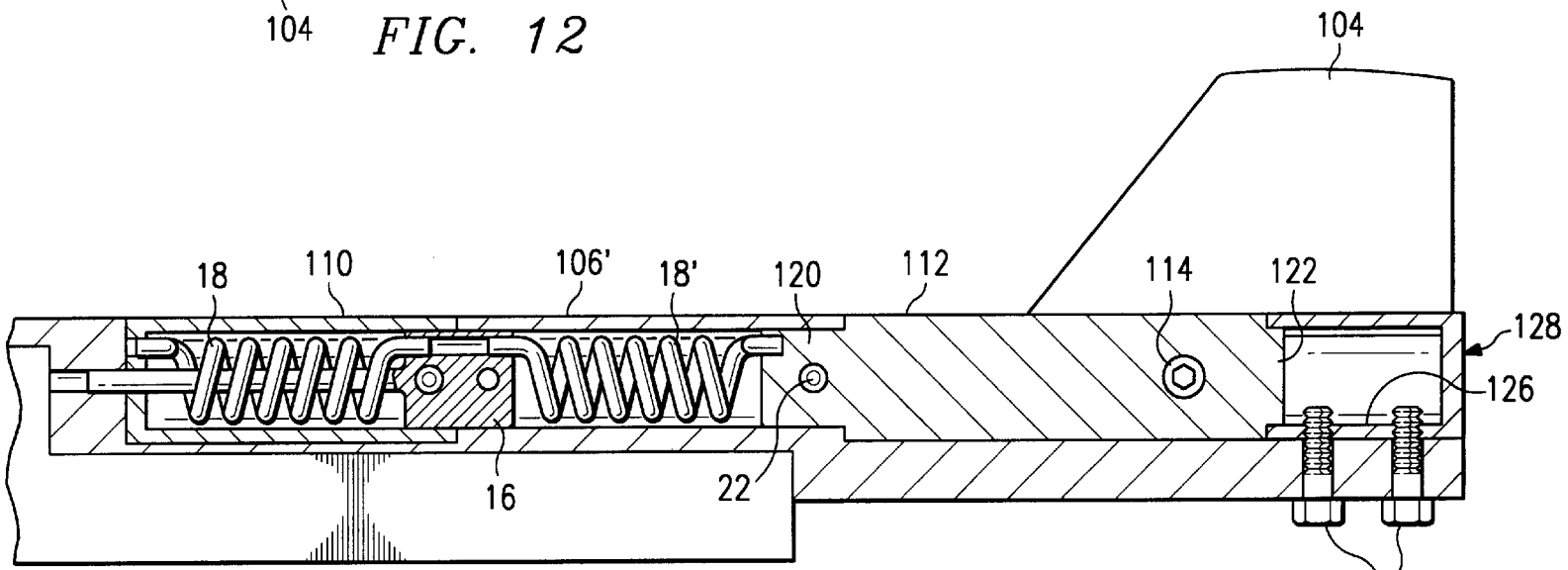
FIG. 13 is a cross section of FIG. 12 taken along line 13—13.

With reference now to FIGS. 11–13, a single axis folding and locking mechanism 100 forming a second embodiment of the present invention will be described. Many elements of the mechanism 100 are identical to those previously described in mechanism 10 and are thus identified by the same reference numeral. Mechanism 100 is used to actuate a pair of wings 102 and a pair of control fins 104. The wings 102 and fins 104 are carried on the same supporting structure, a structural body 106, which can, in turn, be part of a missile, rocket or other device.

The structural body 106 is used to mount all aerodynamic surfaces and provides the folding axes 108 for both the wings 102 and control fins 104. Structural body 106, wings 102 and control fins 104 are constructed in such a manner that left and right wings 102 may overlap each other when folded, as can the left and the right control fins 104. This arrangement allows folding the aerodynamic surfaces into a compact package no deeper than the overall diameter of the barrel containing the torsion springs.

While the folding and locking mechanics of wings 102 are similar to those of mechanism 10, a difference is that the center portion of the barrel 110 containing the torsion spring 18 is part of the wing 102, not part of the support base as in mechanism 10. This variation requires that the pivot axle 16 be secured to the structural body 106 with a pivot axle securing pin 20 passing through the aperture 64. Hence, the pivot axle 16 does not move during deployment. Thus, wings 102 and the attached barrel 110 rotate about the pivot axle 16 when driven by the torsion spring 18.

The locking pin 22 is carried in the same position on the pivot axle 16 as in mechanism 10. The tapered surface 46 and aperture 44 that interfaces with the locking pin 22 is now machined into the barrel 110 on the wing 102. This is exactly opposite the mechanism 10. When the wing 102 rotates to the proper erected position, the locking pin 22 is driven into tapered surface 46 of aperture 44 on the wing 102 by the locking pin actuation spring 24. The manner of engaging the ends of the torsion spring 18 are similar to mechanism 10, with the ends, however, received in the stationary pivot axle 16 at one end and in the pivoting barrel 110 at the other end.

The control fins 104 also have a variation over mechanism 10. A second torsion spring 18' drives the control fin actuator 112 for erection of the fin 104. The control fin 104 is directly mounted to the control fin actuator 112. Control fin 104 is thus deployed to the erected position as the torsion spring 18' rotates the entire control fin actuator 112. This arrangement allows very secure mounting of the control fin 104 to the control fin actuator 112 with retaining screw 114. It also eliminates the possibility of a control fin 112 not deploying into a specific position relative to the control fin actuator drive axis 116 as could happen with mechanism 10 if the locking pin 22 does not engage properly.

The erection pivot axis 118 (which in the embodiment illustrated in FIGS. 11–13 coincides with axis 108) of the control fin 104 is created by reduced diameter portions 120 and 122 at each end of the actuator 112. The forward reduced diameter portion 120 of the actuator 112 interfaces with an aperture 124 of a barrel 106' on the structural body 106 and the aft reduced diameter portion 122 interfaces with an aperture 126 in a control actuator retainer 128. Screws 130 affix the control actuator retainer 128 to the structural body 106. A recess for a locking pin 22 and locking pin spring 24 is also machined in the forward end 120 of the control fin actuator 112, similar to the recess for the locking mechanism in the pivot axle 16. The control fin locking pin 22 interfaces with a tapered surface 46 and aperture 44 machined near the aft end of the barrel 106' to perform the locking function for the control fin and actuator erection.

The mechanism 100 illustrated in FIGS. 11–13 uses a common fold axis 108, 118 for the wing 102 and control fin 104 on each side of the structural body 106 to provide a reduction in parts count and machining requirements. The fold axis for the wings and control fins could, however, be displaced relative to one another. As illustrated in FIGS. 11–13, individual torsion springs 18 and 18' and locking pins 22 are used for the wings 102 and control fins 104. This allows the wings 102 and control fins 104 to be erected through different angles of rotation and provides for variation of dihedral angles between the wings and fins as a means of reducing wing down-wash interference on the control fin. However, an arrangement could be created that required only one torsion spring 18, one locking pin 22, one locking pin spring 24 and one tapered surface 46 or aperture 44 for the erection of both the wing 102 and control fin 104 on a given side of the structural body 106.

Although the present invention has been described with respect to specific preferred embodiments thereof, various changes and modifications may be suggested to one skilled in the art. It is intended that the present invention encompass such changes and modifications as fall within the scope of the appended claims.

What is claimed is:

1. A hinge and locking mechanism to deploy a member, comprising:

a support base;

an erectable member;

a pivot axle secured to one of the support base and erectable member and pivotally engaged to the other, with the erectable member for rotation about a first axis between a storage position and an erected position; and a spring element urging the erectable member to rotate in a first direction about the first axis to the erected position, wherein the pivot axle has a first portion of larger diameter and a second portion of smaller diameter, the spring element having a first end, the pivot axle receiving said first end of said spring element, and wherein the erectable member has a first barrel for receiving the large diameter portion of the pivot axle and a second barrel for receiving a portion of the smaller diameter portion of the pivot axle.

2. The hinge and locking mechanism of claim 1 further comprising a locking pin movable between an unlocked position and a locked position to lock the erectable member in the erected position when the locking pin is in the locked position.

3. The hinge and locking mechanism of claim 2 further comprising a locking pin spring element to urge the locking pin into the locked position.

4. The hinge and locking mechanism of claim 2 wherein the support base has an aperture to receive said locking pin in the erected position of the erectable member.

5. The hinge and locking mechanism of claim 1 further comprising a deformable bump stop to cushion the movement of the erectable member into the erected position relative to the support base.

6. The hinge and locking mechanism of claim 1 wherein the spring element is a helical spring.

7. The hinge and locking mechanism of claim 1 wherein the pivot axle is secured to the support base.

8. The hinge and locking mechanism of claim 1 wherein the pivot axle is secured to the erectable member.

9. The hinge and locking mechanism of claim 1 wherein the pivot axle is secured to said erectable member, the spring element having a second end, the second end engaging said support base.

10. The hinge and locking mechanism of claim 9 wherein the pivot axle is secured to the erectable member by a securing pin.

11. The hinge and locking mechanism of claim 1 wherein the pivot axle has a slot on the end for rotating the pivot axle about the first axis to tension the spring element.

12. A hinge and locking mechanism to deploy a member, comprising:

a support base;

an erectable member;

a pivot axle secured to one of the support base and erectable member and pivotally engaged to the other, with the erectable member for rotation about a first axis between a storage position and an erected position; and a spring element urging the erectable member to rotate in a first direction about the first axis to the erected position, wherein the hinge and locking mechanism further comprises a second erectable member, a pivot member pivotally secured to said support base for rotation about a second axis, said second erectable member mounted on said pivot member and a second spring element urging the second erectable member and pivot member to rotate in a first direction about the second axis to the erected position.

13. The hinge and locking mechanism of claim 12 wherein the first and second axes are coincident.

14. A hinge and locking mechanism to deploy a member, comprising:

a support base having a passage with a portion of first, larger diameter and a portion of second, smaller diameter;

an erectable member having a first barrel and a second barrel, the first barrel having a through passage of first, larger diameter and the second barrel having a passage of second, smaller diameter;

a pivot axle secured to said erectable member, said pivot axle having a first larger diameter portion received in part in the first barrel of the erectable member and in the first larger diameter portion of the support base and a second smaller diameter received in part in the second smaller diameter portion of the second barrel and the second smaller diameter portion of the support base to secure the erectable member to the support base for pivotal motion about a first axis;

a spring element having a first end and a second end, a first end received in said pivot axle at a transition between the first, larger diameter and the second, smaller diameter, the second end received in the support base at a transition between the first, larger diameter and the second, smaller diameter;

a locking pin mounted in said pivot axle for movement between an unlocked position and a locked position, a locking pin spring urging the locking pin into the locked position, said support base having an aperture formed therein for receiving a portion of the locking pin when the locking pin is in the locked position, movement of the erectable member to the erected position permitting the locking pin to move into the aperture in the support base to lock the erectable member in the erected position; and a deformable bump stop mounted on said support base to cushion the movement of the erectable member into the erected position relative to the support base.

15. The hinge and locking mechanism of claim 14 wherein the pivot axle is secured to the erectable member by a securing pin.

16. The hinge and locking mechanism of claim 14 wherein the pivot axle has a slot, permitting the pivot axle to be rotated about the first axis relative to the support base to adjust the tension of the spring element before the pivot axle is secured to the erectable member.

17. A hinge and locking mechanism to deploy a member, comprising:

a structural body having a barrel with a passage therethrough;

a first erectable member having a barrel with a passage formed therethrough;

a pivot axle having a first portion of larger diameter and a second portion of smaller diameter secured to the barrel of the structural body, the pivot axle supporting the first erectable member for pivotal movement relative the structural body from a storage position to an erected position about a first axis;

a first spring element mounted between said first erectable member and said pivot axle for urging the first erectable member into the erected position;

a retainer mounted on said structural body;

a pivot member pivotally secured between the barrel of the structural body and the retainer for pivotal motion about the first axis;

a second erectable member mounted to said pivot member; and a second spring element acting between said pivot axle and said pivot member to pivot the pivot member and second erectable member from a storage position to an erected position.

18. The hinge and locking mechanism of claim 17 wherein the first erectable member is a wing and the second erectable member is a control fin.

* * * * *